US005752604A

United States Patent [19]

Hayman

[11] Patent Number: 5,752,604

[45] Date of Patent: May 19, 1998

[54] PILL CONTAINER

[76] Inventor: Walter B. Hayman, 51 Derwen Rd., Bala Cynwyd, Pa. 19004

[21] Appl. No.: 734,612

[22] Filed: Oct. 18, 1996

[51] Int. Cl.[6] ..... B65D 55/02

[52] U.S. Cl. ..... 206/534; 206/508; 206/540; 215/211; 215/356

[58] Field of Search ..... 206/528, 535, 206/508, 503, 459.5, 534, 540, 823, 509; 215/211–213, 217, 223, 305, 332, 356, 230; 220/17.1, 17.2, 212.5, 23.83, 380, 293

[56] References Cited

U.S. PATENT DOCUMENTS

| | | | |
|---|---|---|---|
| 2,020,587 | 11/1935 | Stock | 206/823 |
| 2,565,090 | 10/1953 | Hamblet | 206/823 |
| 3,001,564 | 9/1961 | Hopkins | 206/508 |
| 3,567,058 | 3/1971 | Mascia | 215/213 |
| 3,604,583 | 9/1971 | Linkletter | 215/213 |
| 4,434,903 | 3/1984 | Cooke | 215/223 |
| 4,458,820 | 7/1984 | Abrams | 215/230 |
| 4,562,933 | 1/1986 | Dennis . | |
| 4,685,579 | 8/1987 | Stapleton | 206/534 |
| 4,802,438 | 2/1989 | DeJonge | 206/534 |
| 4,830,206 | 5/1989 | Fisher | 215/211 |
| 4,995,520 | 2/1991 | Santaguiliana . | |
| 5,165,603 | 11/1992 | Hahn | 206/823 |
| 5,383,559 | 1/1995 | Toren | 206/528 |
| 5,397,008 | 3/1995 | Glynn . | |

*Primary Examiner*—Paul T. Sewell
*Assistant Examiner*—Luan K. Bui
*Attorney, Agent, or Firm*—Caesar, Rivise, Bernstein, Cohen & Pokotilow, Ltd.

[57] ABSTRACT

A pill container having a cylindrical body portion, whose diameter is greater than its height, and an upwardly dome-shaped lid with laterally-extending handles to facilitate grasping. The body portion includes an upwardly dome-shaped bottom surface so that a plurality of these pill containers can be stacked on top of one another.

6 Claims, 3 Drawing Sheets

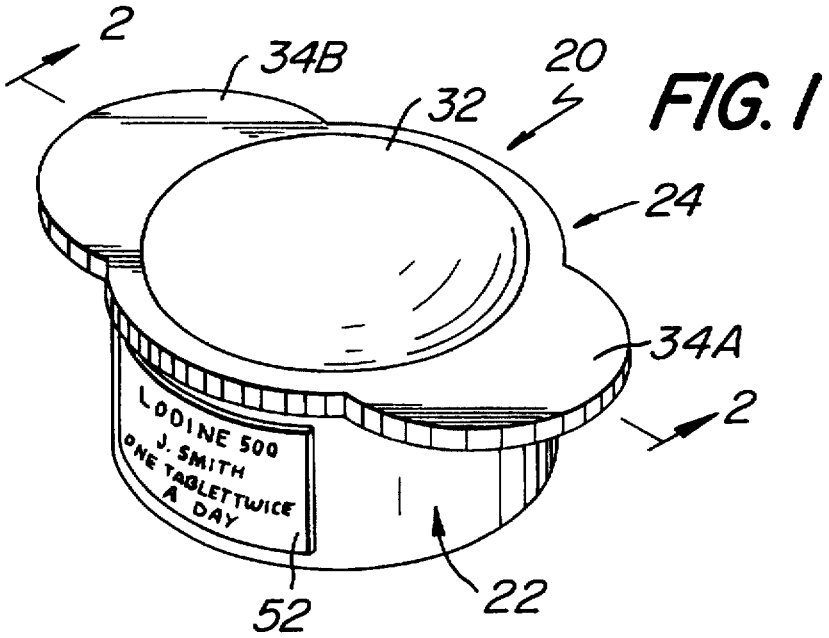
FIG. 1
FIG. 2
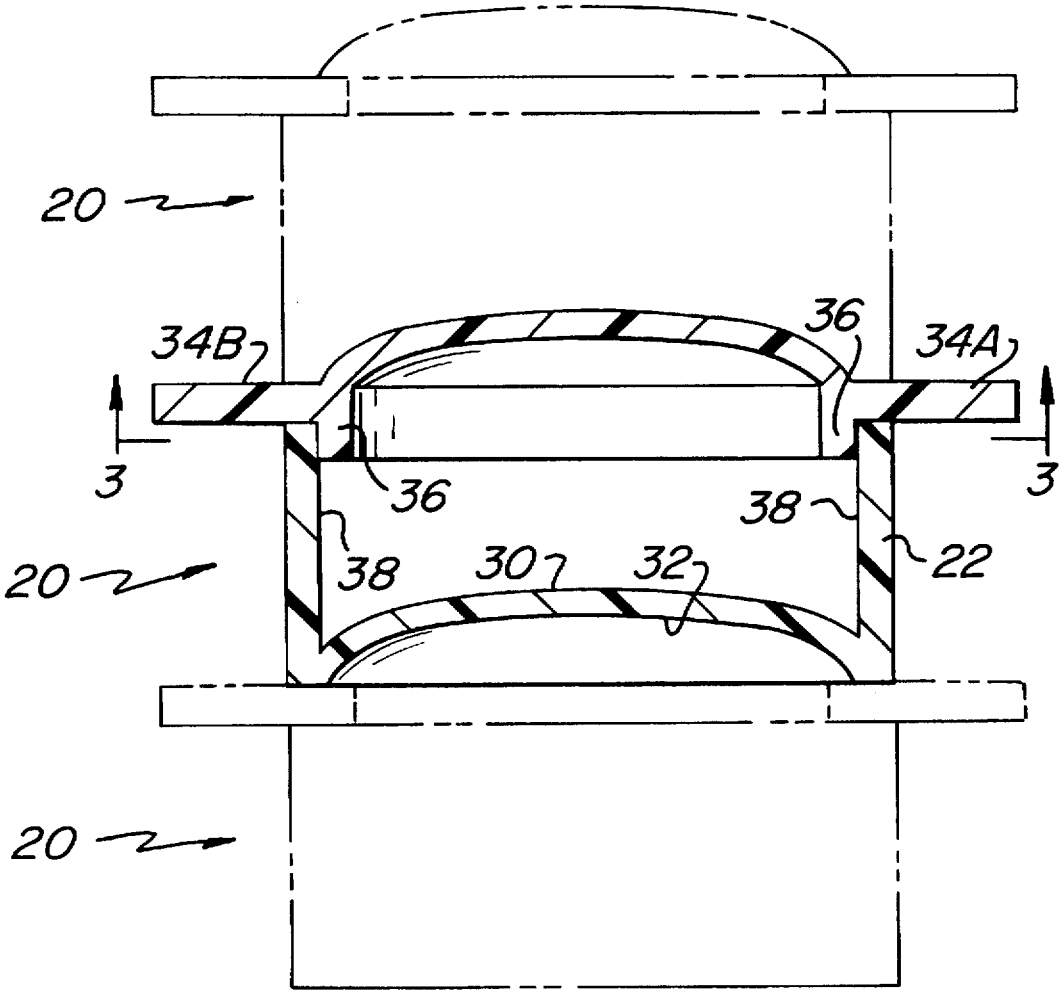

PILL CONTAINER

FIELD OF THE INVENTION

This invention relates generally to the field of containers, more particularly, to pill containers.

BACKGROUND OF THE INVENTION

Conventional pill containers are cylindrical and elongated in shape, having a flat twist cap or pop-off cap. The diameters of these containers tend to be small also. Such features make these pill containers hard to handle, especially for people with arthritis or other hand impairments. The elongated, small diameter design of these pill containers make these containers unstable when standing on a flat surface, i.e., they can easily tip over if pushed slightly. In addition, such an elongated, small diameter design makes these pill containers too unstable to stack on top of one another. Finally, the labels attached to the sidewall of these small diameter pill containers are not easily readable because the labels must bend around in conformance with the sidewalls, thus making it difficult for the patient to read the entire label without having to turn the container as he/she reads; such difficulty could be life-threatening if, for example, the patient misreads the proper amount and/or times for taking the medicine.

Therefore, it is believed that a need exists for a pill container that can be handled easily by a patient, is readily stackable with other such pill containers, is stable when on a flat surface and which provides a surface for mounting a label that can be easily read without having to rotate the container when reading the label.

OBJECTS OF THE INVENTION

Accordingly, it is the general object of this invention to provide an apparatus which addresses the aforementioned needs.

It is a further object of this invention to provide a pill container that is easy to handle by a patient.

It is yet another object of this invention to provide a pill container having good stability when standing on a flat surface.

It is still yet a further object of this invention to provide a pill container that is stackable with similar pill containers and whereby the stack also exhibits good stability.

It is still yet even a further object of this invention to provide a pill container that permits a label attached thereto to be easily readable without the need to rotate the pill container while reading the label.

SUMMARY OF THE INVENTION

These and other objects of the instant invention are achieved by providing a pill container comprising a cylindrical body portion having a diameter greater than its height. The cylindrical body portion includes a dome-shaped bottom surface that is upwardly-directed. The pill container also comprises a lid adapted to be releasably secured to the cylindrical body portion and whereby the lid comprises a dome-shaped central portion upwardly-directed. Finally, the pill container comprises a means for releasably securing the lid to the cylindrical body portion.

DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 1 is an isometric view of the pill container, as viewed from the top;

FIG. 2 is a cross-sectional view of the pill container, taken along line 2—2 of FIG. 1, disposed in a stack of similar pill containers shown in phantom;

DESCRIPTION OF THE PREFERRED EMBODIMENT OF THE INVENTION

Figure 3:
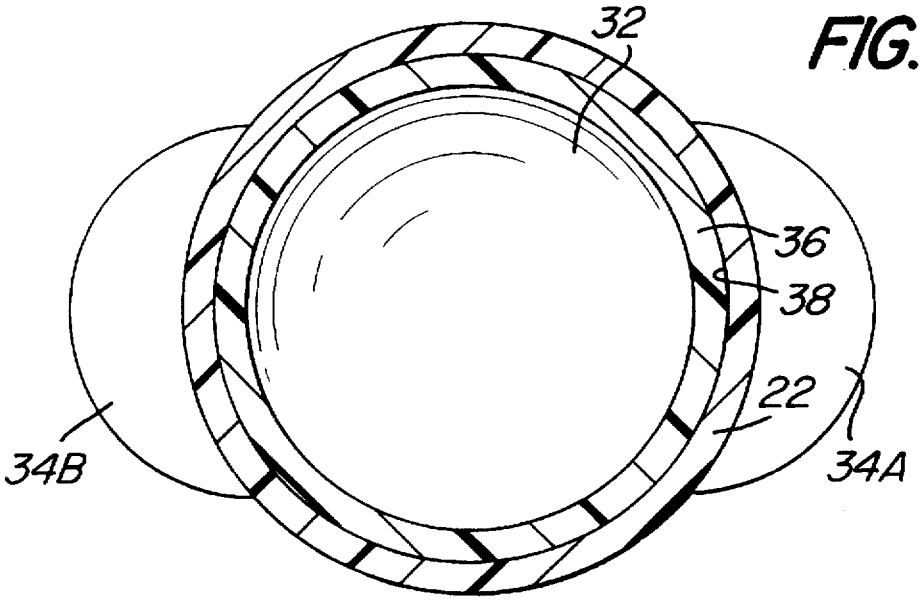
FIG. 3 is a cross-sectional view of the pill container taken along line 3—3 of FIG. 2.

Referring now in greater detail to the various figures of the drawing wherein like reference characters refer to like parts, an ergonomic pill container constructed in accordance with the present invention is shown generally at 20 in FIG. 1.

In particular, the container 20 comprises a body portion 22 and a lid 24. The body portion 24 is cylindrical and its diameter 26 is greater than its height 28, as shown most clearly in FIG. 4. This relationship between the diameter 26 and the height 28 provides the pill container 20 with a low center of gravity that makes the pill container 20 stable when it is standing on a flat surface. The bottom surface 30 (FIG. 2 and 4) of the body portion 24 is dome-shaped upwardly into the body portion 22, the significance of which will be discussed next.

The lid 24 also comprises a dome-shaped central portion 32 with two laterally-extending handles 34A and 34B. The dome-shaped central portion 32 is upwardly-directed as shown in FIGS. 1–2 and 5–7. As such, a plurality of the pill containers 20 can be stacked on top of one another as shown in FIG. 2, with the dome-shaped central portion 32 of a lower pill container 20 fitting within the dome-shaped bottom surface 30 of an upper pill container 20. This "dome-to-dome" interface provides stability to the stack so that the stack cannot be easily knocked over as would occur if a stack of standard elongated, flat-lid pill containers (not shown) were slightly pushed. As such, a plurality of stacks (not shown) of pill containers 20 can be located in a common area (e.g., medicine chest) without being prone to accidental spillage of the containers 20 out of the common area, as occurs when stacks of conventional elongated, flat-lid pill containers, stored in a common area, are slightly contacted.

Figure 6:
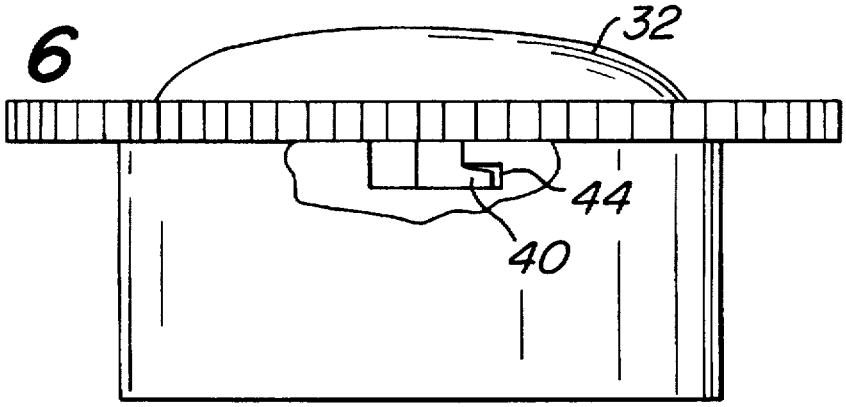
FIG. 6 is a side elevation, partially-broken view of the pill container showing the rear-most L-shaped member of FIG. 4 locked in its respective L-shaped receptacle.
Figure 7:
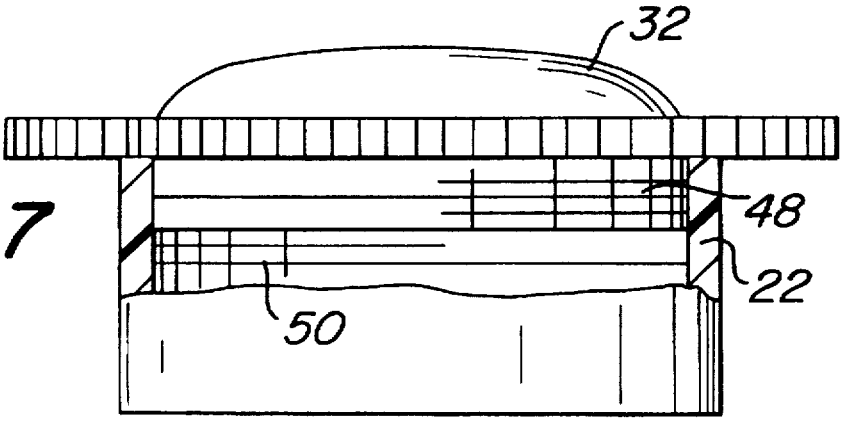
FIG. 7 is a side elevation view of the pill container, partially-broken away, showing a threaded releasable securing means.

The lid 24 is releasably secured to the body portion 22 through a releasable securing means, e.g., a press fit (FIGS. 2–3), a bayonet lock (FIGS. 4–6) or a threaded mechanism (FIG. 7). It should be noted that these are only exemplary releasable securing means and they do not constitute a limitation on the present invention; it is within the broadest scope of this invention to include any other type of releasable securing means for securing the lid 24 to the body portion 22. For example, the releasable securing means could also be a child-proof releasable securing means as disclosed in U.S. Pat. No. 5,397,008 (Glynn), U.S. Pat. No. 4,562,933 (Dennis) and U.S. Pat. No. 4,995,520 (Santagiuliana), all of whose disclosures are incorporated by reference herein, and does not constitute a limitation on the present invention.

With respect to the press fit as shown in FIGS. 2–3, a peripheral flange 36 extends downward along the periphery of the dome-shaped central portion 32 of the lid 24. This peripheral flange 36 forms a tight fit against an inner wall 38 of the body portion 22 when the patient forces the lid 24 down against the body portion 22. Although not shown, an alternative press fit includes a downwardly-projecting flange that encompasses the outer wall of the body portion 22.

Figure 4:
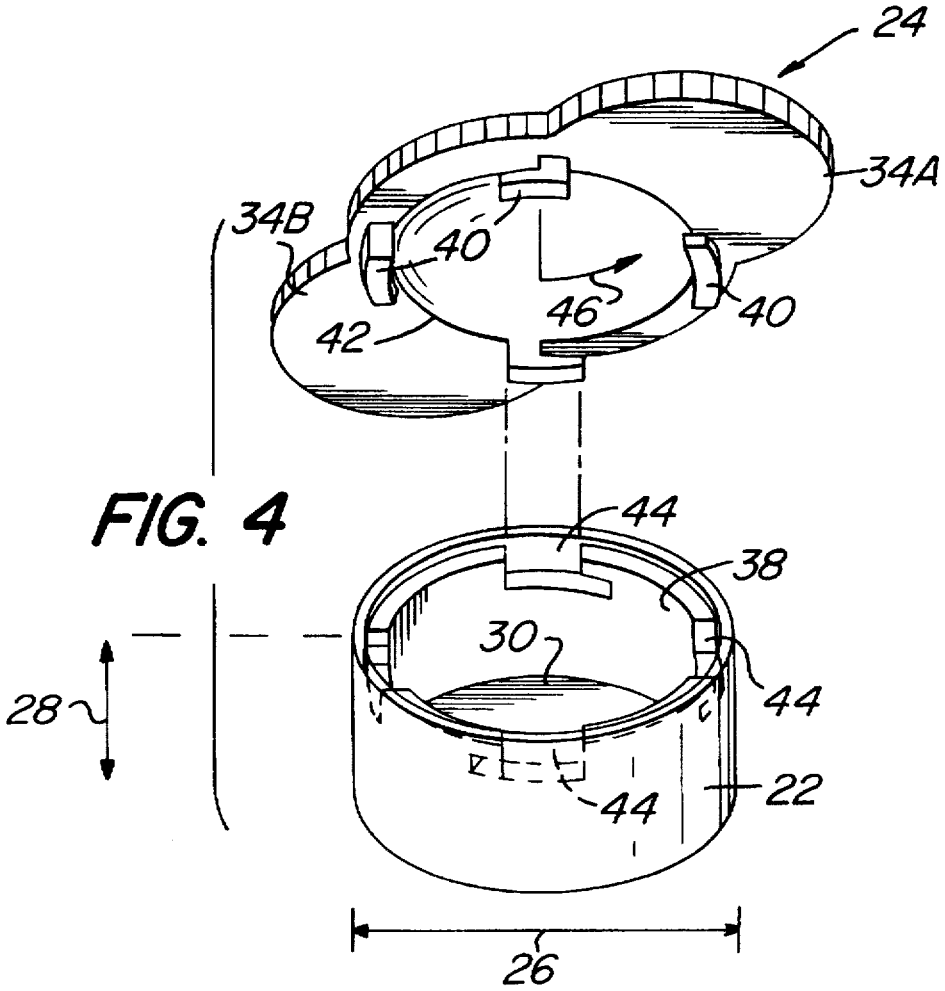
FIG. 4 is an isometric view of the pill container as in FIG. 1 but with the lid removed showing a bayonet securing means.
Figure 5:
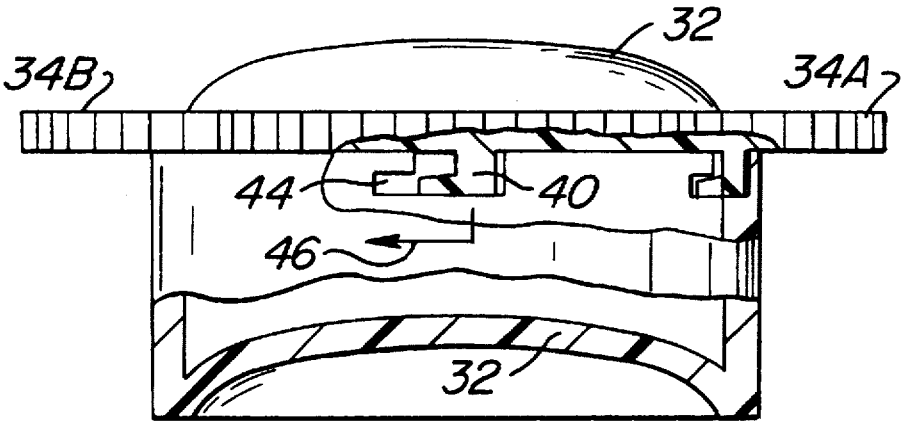
FIG. 5 is a side elevation, partially in cross-section, view of the pill container showing the front-most L-shaped member of FIG. 4 seated in its respective L-shaped receptacles.

With respect to the bayonet lock as shown in FIGS. 4–6, the bayonet lock comprises a plurality of L-shaped members 40 coupled to the underside surface 42 of the lid 24, around the periphery of the dome-shaped central portion 32. Within the inner wall 38 of the body portion 22 are L-shaped receptacles 44 for receiving respective L-shaped members 40. As shown most clearly in FIG. 4, in order to releasably secure the lid 24 to the body portion 22, the patient places the lid 24 on top of the body portion 22 and turns the lid in the direction shown by the arrow 46 (FIGS. 4–5). This action seats the L-shaped members 40 in respective L-shaped receptacles 44 (FIG. 5) and further rotation in the direction 46 locks the lid 24 onto the body portion 22 (FIG. 6).

With respect to the threaded mechanism (FIG. 7), the lid 24 also includes the peripheral flange 36 but with threads 48 on the external wall of the flange 36. The upper portion of the inner wall 38 of the body portion 22 also includes corresponding threads 50 so that when the peripheral flange 36 is placed at the top of the body portion 22, the patient can simply secure the lid 24 to the body portion 24 via a rotating action. Although not shown, an alternative threaded mechanism includes a downwardly-projecting flange having threads on an internal wall that engage threads on the outer wall of the upper portion of the body portion 24.

The laterally-extending handles 34A and 34B provide an easy to grip lid 24 that a patient with a hand-impairment, e.g., arthritis, can easily maneuver to remove or secure the lid 24 to the body portion 24. The large surface area presented by the handles 34A/34B allow the patient to grip the lid 24, without having to tightly bend the fingers as would be necessary when grasping lids of conventional cylindrical pill containers. These handles 34A/34B facilitate the grasping of the lid 24 in any of the exemplary releasable securing mechanisms described above or in any other conventional releasable securing mechanisms.

Furthermore, because the body portion 24 is cylindrical and its diameter 26 is greater than its height 28, another feature is provided to the pill container 22: the display of a label 52 (FIG. 1) is such that the entire label 52 is easily readable in a single glance by the patient without the need to rotate the pill container 20 as he/she reads it. In contradistinction, the elongated, cylindrical design of conventional pill containers require that the label, containing important dosage and/or warnings, bend away from the patient's sight when looking at the label; thus, the patient must rotate the container as he/she reads it, making it difficult to obtain the necessary information in a single glance. This could pose a life-threatening situation should the patient not properly read the label and thus take an improper dosage at an improper time.

The body portion 22 may comprise any FDA-approved plastic, having the conventional brown-tinted color of other pill containers. Similarly, the lid 24 may comprise any FDA-approved plastic used for pill containers lids.

Without further elaboration, the foregoing will so fully illustrate my invention that others may, by applying current or future knowledge, readily adopt the same for use under various conditions of service.

I claim:

1. A container comprising:

a cylindrical body portion having a diameter greater than its height, said cylindrical body portion including a dome-shaped bottom surface that is upwardly-directed;

a lid adapted to be releasably secured to said cylindrical body portion for forming the entire top surface of said container when said lid is releasably secured thereto, said lid comprising a dome-shaped central portion upwardly-directed;

means for releasably securing said lid to said cylindrical body portion; and a planar portion extending laterally from said dome-shaped central portion of said lid for supporting another one of said containers stacked on top of said container; and wherein said lid comprises laterally-extending handles that are formed integral with said laterally-extending planar portion.

2. The container of claim 1 wherein said releasable securing means comprises a threaded portion on the lid and a threaded portion on the upper portion of said cylindrical body portion, said threaded portion on said lid engaging said threaded portion on said upper portion of said cylindrical body portion for releasably securing said lid to said cylindrical body portion.

3. The container of claim 2 wherein said threaded portion on said upper portion of said cylindrical body portion comprises a threaded inner wall in said upper portion of said cylindrical body portion and said threaded portion on the lid comprises a downwardly-projecting flange, having a threaded external wall, coupled to a bottom surface of said lid, said threaded inner wall of said cylindrical body portion engaging said threaded external wall of said downwardly-projecting flange for releasably securing said lid to said cylindrical body portion.

4. The container of claim 1 wherein said releasable securing means comprises a plurality of L-shaped members projecting downwardly from a bottom surface of said lid and a respective plurality of L-shaped receptacles in an inner wall of said cylindrical body portion, said L-shaped members engaging said respective L-shaped receptacles for releasably securing said lid to said cylindrical body portion.

5. The container of claim 1 wherein said releasable securing means comprises a downwardly-projecting flange coupled to a bottom surface of said lid to form a press fit with said body portion for releasably securing said lid to said cylindrical body portion.

6. The container of claim 1 wherein a label is attached to said body portion, said label being readable at a single glance without requiring said container to be rotated.

* * * * *